US006883443B2

(12) United States Patent
Rettig et al.

(10) Patent No.: US 6,883,443 B2
(45) Date of Patent: Apr. 26, 2005

(54) METHOD FOR REDUCTION OF SLAGGING AND FOULING OF THE WATERWALLS AND OF THE FIREBOX AND SUPERHEATER AND REHEATER OF STEAM BOILERS WITH COAL COMBUSTION

(75) Inventors: Terry W. Rettig, Los Altos, CA (US); T. Steven I. Torbov, San Jose, CA (US)

(73) Assignee: Aptech Engineering Services, Inc., Sunnyvale, CA (US)

( * ) Notice: Subject to any disclaimer, the term of this patent is extended or adjusted under 35 U.S.C. 154(b) by 0 days.

(21) Appl. No.: 10/655,229

(22) Filed: Sep. 3, 2003

(65) Prior Publication Data

US 2004/0045489 A1 Mar. 11, 2004

Related U.S. Application Data

(60) Provisional application No. 60/409,611, filed on Sep. 9, 2002, and provisional application No. 60/410,489, filed on Sep. 12, 2002.

(51) Int. Cl.[7] ..... F23B 7/00; F23J 15/00

(52) U.S. Cl. ..... 110/343; 110/348; 110/215

(58) Field of Search ..... 110/343, 348, 110/204, 215, 205, 254

(56) References Cited

U.S. PATENT DOCUMENTS 4,056,068 A * 11/1977 Hafeli ..... 110/345
4,223,640 A * 9/1980 Rochford et al. ..... 122/1 R
4,498,402 A * 2/1985 Kober et al. ..... 110/345
4,616,574 A * 10/1986 Abrams et al. ..... 110/343
4,642,225 A * 2/1987 Leikert ..... 423/244.06
4,796,548 A * 1/1989 Merrell et al. ..... 110/343
4,873,930 A * 10/1989 Egense et al. ..... 110/345
5,309,850 A * 5/1994 Downs et al. ..... 110/235
5,313,895 A * 5/1994 Sekiguchi et al. ..... 110/346
5,683,550 A * 11/1997 Ryham ..... 162/30.1
5,685,243 A * 11/1997 Gohara et al. ..... 110/345
6,213,032 B1 * 4/2001 Breen et al. ..... 110/345

* cited by examiner

*Primary Examiner*—Kenneth Rinehart
(74) *Attorney, Agent, or Firm*—Haverstock & Owens LLP

(57) ABSTRACT

The present invention is a method for reducing the slagging and fouling of the surfaces of the waterwalls, firebox, superheater, and reheater of the furnace of a coal-fired steam boiler. The process reduces the firebox exit temperature to below the specific ash melting temperature by injecting the following, either alone or in combination, into ports located in the upper section of the firebox: recirculated flue gas from downstream of the electrostatic precipitator, atomized water, or a sorbent water slurry. All of these materials have a lower temperature than the main flue gas or require additional heat for evaporation. Mixing these materials with the main flue gas from the furnace will not affect the coal combustion process, yet will reduce the temperature of any fly ash particles in the main flue gas to below the specific ash fusion temperature, and thus, prevent slagging and fouling within the furnace.

39 Claims, 4 Drawing Sheets

METHOD FOR REDUCTION OF SLAGGING AND FOULING OF THE WATERWALLS AND OF THE FIREBOX AND SUPERHEATER AND REHEATER OF STEAM BOILERS WITH COAL COMBUSTION

RELATED APPLICATIONS

This Patent Application claims priority under 35 U.S.C. §119 (e) of the co-pending U.S. Provisional Patent Application, Ser. No. 60/409,611, filed Sep. 9, 2002, and entitled, "METHOD FOR REDUCTION OF SLAGGING AND FOULING OF THE WATERWALLS AND OF THE FIREBOX AND SUPERHEATER AND REHEATER OF STEAM BOILERS WITH COAL COMBUSTION." The Provisional Patent Application, Ser. No. 60/409,611, filed Sep. 9, 2002, and entitled, "METHOD FOR REDUCTION OF SLAGGING AND FOULING OF THE WATERWALLS AND OF THE FIREBOX AND SUPERHEATER AND REHEATER OF STEAM BOILERS WITH COAL COMBUSTION" is also hereby incorporated by reference in its entirety.

This Patent Application claims priority under 35 U.S.C. §119 (e) of the co-pending U.S. Provisional Patent Application, Ser. No. 60/410,489, filed Sep. 12, 2002, and entitled, "METHOD OF USING WATER INJECTION IN THE STEAM BOILERS FURNACE WITH COAL COMBUSTION TO PREVENT SLAGGING AND FOULING IN THE FURNACE AND THE CONVECTIVE PASS." The Provisional Patent Application, Ser. No. 60/410,489, filed Sep. 12, 2002, and entitled, "METHOD OF USING WATER INJECTION IN THE STEAM BOILERS FURNACE WITH COAL COMBUSTION TO PREVENT SLAGGING AND FOULING IN THE FURNACE AND THE CONVECTIVE PASS" is also hereby incorporated by reference in its entirety.

FIELD OF THE INVENTION

The present invention relates generally to improving the efficiency of coal-based power generation plants. More specifically, the present invention relates to the field of reducing the slagging and fouling at the exit of the coal boiler firebox.

BACKGROUND OF THE INVENTION

Some coal boiler furnaces in use today were designed two to three decades ago. For economical reasons, these older furnaces were designed with an undersized firebox. Consequently, the furnace lacks enough surface area to effectively absorb the heat generated by the burning of the coal, and temperatures in the furnace are elevated. When the temperature of the flue gas at the exit of the firebox exceeds the specific coal ash melting temperature, the ash in the flue gas melts or partially melts so that ash deposits on the surfaces of the furnace, resulting in hard slag deposits.

These older coal boilers have been converted in the intervening years to burn types of coal that are different from what the boiler furnaces were originally designed for. Younger coal deposits are being used presently, and since younger coal tends to have more volatile content, the temperatures reached in the furnace are higher. Similar to and in conjunction with the problems related to an undersized furnace, the temperature of the heated flue gas at the exit of the firebox exceeds the ash fusion temperature, resulting in slagging and fouling of the surfaces of the waterwalls, firebox, superheater, and reheater of the steam boiler.

The problem of achieving a reduction in the temperature of the flue gas at the exit of the firebox to just below the specific ash melting temperature in order to control the slagging and fouling of the steam boiler has not been adequately resolved.

SUMMARY OF THE INVENTION

The present invention is a method for reducing the slagging and fouling of the surfaces of the waterwalls, firebox, superheater, and reheater of the furnace of a coal-fired steam boiler. The process reduces the firebox exit temperature to below the specific ash melting temperature by injecting the following, either alone or in combination, into ports located in the upper section of the firebox: recirculated flue gas from downstream of the electrostatic precipitator, atomized water, or a sorbent water slurry. All of these materials have a lower temperature than the main flue gas or require additional heat for evaporation. Mixing these materials with the main flue gas from the furnace will not affect the coal combustion process, yet will reduce the temperature of any fly ash particles in the main flue gas to below the specific ash fusion temperature, and thus, prevent slagging and fouling within the furnace.

In one aspect of the present invention, a method of reducing slagging and fouling in a furnace of a coal-fired steam boiler comprises diverting cooled flue gas from an output of a flue gas filter, wherein the flue gas filter is configured to clean the cooled flue gas by removing fly ash particulates, recirculating the cooled flue gas to one or more ports in an upper section of a firebox in the furnace, injecting the cooled flue gas into at least one of the one or more of the ports into the upper section of the firebox and mixing the cooled flue gas with hot flue gas from the furnace, the hot flue gas having a higher temperature than the cooled flue gas, wherein the mixing reduces the higher temperature of the hot flue gas from the furnace to below a threshold temperature. The method further comprises the flue gas filter receiving flue gas from an air preheater. The method further comprises the air preheater receiving flue gas from the furnace. The flue gas filter is an electrostatic precipitator or a bag house. The threshold temperature is a temperature at which fly ash melts and forms slag deposits.

In another aspect of the present invention, a method of reducing slagging and fouling in a furnace of a coal-fired steam boiler comprises atomizing a water-based coolant, injecting the water-based coolant through at least one of one or more ports into an upper section of a firebox in the furnace and mixing the water-based coolant with hot flue gas from the furnace, the hot flue gas having a higher temperature than the water-based coolant, wherein the mixing reduces the higher temperature to below a threshold temperature. The water-based coolant is water or a sorbent water slurry, and further wherein the slurry comprises water and a sorbent material. The sorbent material is calcium-based or magnesium-based. Mixing the water-based coolant with the hot flue gas from the furnace evaporates the water and carbonizes the sorbent material in the slurry. The threshold temperature is a temperature at which fly ash melts and forms slag deposits.

In yet another aspect of the present invention, a system for reducing slagging and fouling in a furnace of a coal-fired steam boiler comprises a flue gas duct coupled to a flue gas filter, and further coupled to one or more ports in an upper section of a firebox in the furnace, wherein the flue gas duct is configured to divert cooled flue gas, and further wherein the flue gas filter is configured to clean the cooled flue gas, at least one fan configured to propel the cooled flue gas through the flue gas duct and at least one recirculation jet to inject the cooled flue gas into one or more of the ports in the upper section of the firebox, wherein the cooled flue gas is mixed with hot flue gas from the furnace, and the cooled flue gas reduces the temperature of the hot flue gas from the furnace to below a threshold temperature. The flue gas filter receives flue gas from an air preheater. The air preheater receives flue gas from the furnace. The flue gas filter is an electrostatic precipitator or a bag house. The threshold temperature is a temperature at which fly ash melts and forms slag deposits.

In yet another aspect of the present invention, a system for reducing slagging and fouling in a furnace of a coal-fired steam boiler comprises at least one atomizer for atomizing a water-based coolant and at least one injection jet for injecting the atomized water-based coolant through one or more ports into an upper section of a firebox in the furnace to mix with hot flue gas from the furnace, the hot flue gas having a higher temperature than the water-based coolant, wherein the mixing reduces the higher temperature to below a threshold temperature. The water-based coolant is water or a sorbent water slurry, and further wherein the slurry comprises water and a sorbent material. The sorbent material is calcium-based or magnesium-based. Mixing the water-based coolant with the hot flue gas from the furnace evaporates the water and carbonizes the sorbent material in the slurry. The threshold temperature is a temperature at which fly ash melts and forms slag deposits.

In yet another aspect of the present invention, a system for reducing slagging and fouling in a furnace of a coal-fired steam boiler comprises means for diverting cooled flue gas from an output of a flue gas filter, wherein the flue gas filter is configured to clean the cooled flue gas by removing fly ash particulates, means for recirculating the cooled flue gas to one or more ports in an upper section of a firebox in the furnace, means for injecting the cooled flue gas into one or more of the ports in the upper section of the firebox and means for mixing the cooled flue gas with hot flue gas from the furnace, the hot flue gas having a higher temperature than the cooled flue gas, wherein the mixing reduces the higher temperature to below a threshold temperature. The flue gas filter receives flue gas from an air preheater. The air preheater receives flue gas from the furnace. The flue gas filter is an electrostatic precipitator or a bag house. The threshold temperature is a temperature at which fly ash melts and forms slag deposits.

In yet another aspect of the present invention, a system for reducing slagging and fouling in a furnace of a coal-fired steam boiler comprises means for atomizing a water-based coolant, means for injecting the water-based coolant through one or more ports into an upper section of a firebox in the furnace and means for mixing the water-based coolant with hot flue gas from the furnace, the hot flue gas having a higher temperature than the water-based coolant, wherein the mixing reduces the higher temperature to below a threshold temperature. The water-based coolant is water or a sorbent water slurry, and further wherein the slurry comprises water and a sorbent material. The sorbent material is calcium-based or magnesium-based. Mixing the water-based coolant with the hot flue gas from the furnace evaporates the water and carbonizes the sorbent material in the slurry. The threshold temperature is a temperature at which fly ash melts and forms slag deposits.

In yet another aspect of the present invention, a method of reducing slagging and fouling in a furnace of a coal-fired steam boiler comprises diverting cooled flue gas from an output of a flue gas filter, wherein the flue gas filter is configured to clean the cooled flue gas by removing fly ash particulates, recirculating the cooled flue gas to one or more ports in an upper section of a firebox in the furnace, injecting the cooled flue gas into at least one of the one or more of the ports into the upper section of the firebox, atomizing a water-based coolant, injecting the water-based coolant through at least one of the one or more ports into the upper section of the firebox in the furnace and mixing the cooled flue gas and the water-based coolant with hot flue gas from the furnace, the hot flue gas having a higher temperature than the cooled flue gas and the water-based coolant, wherein the mixing reduces the higher temperature to below a threshold temperature. The method further comprises the flue gas filter receiving flue gas from an air preheater. The method further comprises the air preheater receiving flue gas from the furnace. The threshold temperature is a temperature at which fly ash melts and forms slag deposits. The water-based coolant is water or a sorbent water slurry, and further wherein the slurry comprises water and a sorbent material.

In yet another aspect of the present invention, a system for reducing slagging and fouling in a furnace of a coal-fired steam boiler comprises a flue gas duct coupled to a flue gas filter, and further coupled to one or more ports in an upper section of a firebox in the furnace, wherein the flue gas duct is configured to divert cooled flue gas, and further wherein the flue gas filter is configured to clean the cooled flue gas, at least one fan configured to propel the cooled flue gas through the flue gas duct, at least one recirculation jet to inject the cooled flue gas into at least one of the one or more of the ports in the upper section of the firebox, at least one atomizer for atomizing a water-based coolant and at least one injection jet for injecting the water-based coolant into at least one of the one or more ports in the upper section of the firebox in the furnace, wherein the cooled flue gas and the water-based coolant mix with hot flue gas from the furnace having a higher temperature than the cooled flue gas and the water-based coolant mix, and the cooled flue gas and the water-based coolant reduce the temperature of the hot flue gas to below a threshold temperature. The flue gas filter receives flue gas from an air preheater. The air preheater receives flue gas from the furnace. The threshold temperature is a temperature at which fly ash melts and forms slag deposits. The water-based coolant is water or a sorbent water slurry, and further wherein the slurry comprises water and a sorbent material.

In yet another aspect of the present invention, a system for reducing slagging and fouling in a furnace of a coal-fired steam boiler comprises means for diverting cooled flue gas from an output of a flue gas filter, wherein the flue gas filter is configured to clean the cooled flue gas by removing fly ash particulates, means for recirculating the cooled flue gas to one or more ports in an upper section of a firebox in the furnace, means for injecting the cooled flue gas into at least one of the one or more of the ports into the upper section of the firebox, means for atomizing a water-based coolant, means for injecting the water-based coolant through at least one or more of the one or more ports into the upper section of the firebox in the furnace and means for mixing the cooled flue gas and the water-based coolant with hot flue gas from the furnace, the hot flue gas having a higher temperature than the cooled flue gas and the water-based coolant, wherein the mixing reduces the higher temperature to below a threshold temperature. The flue gas filter receives flue gas from an air preheater. The air preheater receives flue gas from the furnace. The threshold temperature is a temperature at which fly ash melts and forms slag deposits. The water-based coolant is water or a sorbent water slurry, and further wherein the slurry comprises water and a sorbent material.

DETAILED DESCRIPTION OF THE INVENTION

Figure 1:
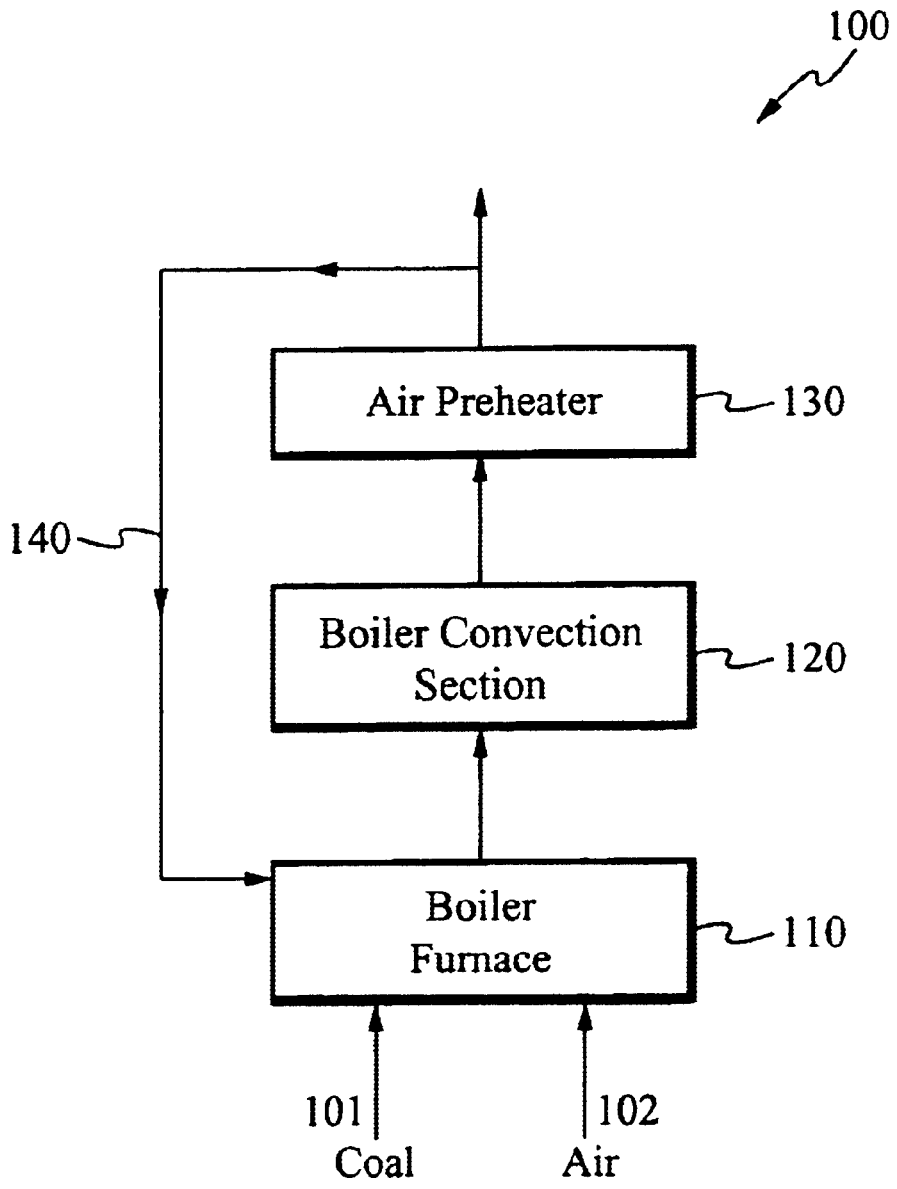
FIG. 1 is a block diagram illustrating a simplified coal-fired utility boiler with flue gas recirculation according to an embodiment of the present invention.

FIG. 1 is a simplified block diagram 100 illustrating a coal-fired utility boiler with flue gas recirculation comprised of a boiler furnace 110, a boiler convection section 120, an air preheater 130, and a recirculation path 140. Coal is fed into the boiler furnace 110 at the coal port 101, and air is fed into the boiler furnace 110 at the air port 102. Combustion of the coal and air mixture results in intense heat and flue gas which contains ash byproducts. The hot flue gas from the combustion of the coal rises into the boiler convection section 120 which contains the superheater and reheater. The main heat exchange from the heat generated in the furnace to the water being heated for the power plant occurs in this section. Next, the flue gas goes through the air preheater 130. The air preheater is used to increase the efficiency of the furnace system by recovering the relatively low level of heat remaining in the flue gas before it is released to the atmosphere. The flue gas for recirculation is taken from the output of the air preheater 130 and sent along the path 140 back to the upper portion of the boiler furnace 110 near where the flue gas exits the boiler furnace 110 before reaching the boiler convection section 120. In this manner, the cooler flue gas from the output of the air heater 130 mixes with the main flue gas coming from the coal combustion in the boiler furnace 110 in order to reduce the temperature of the main flue gas.

Figure 2:
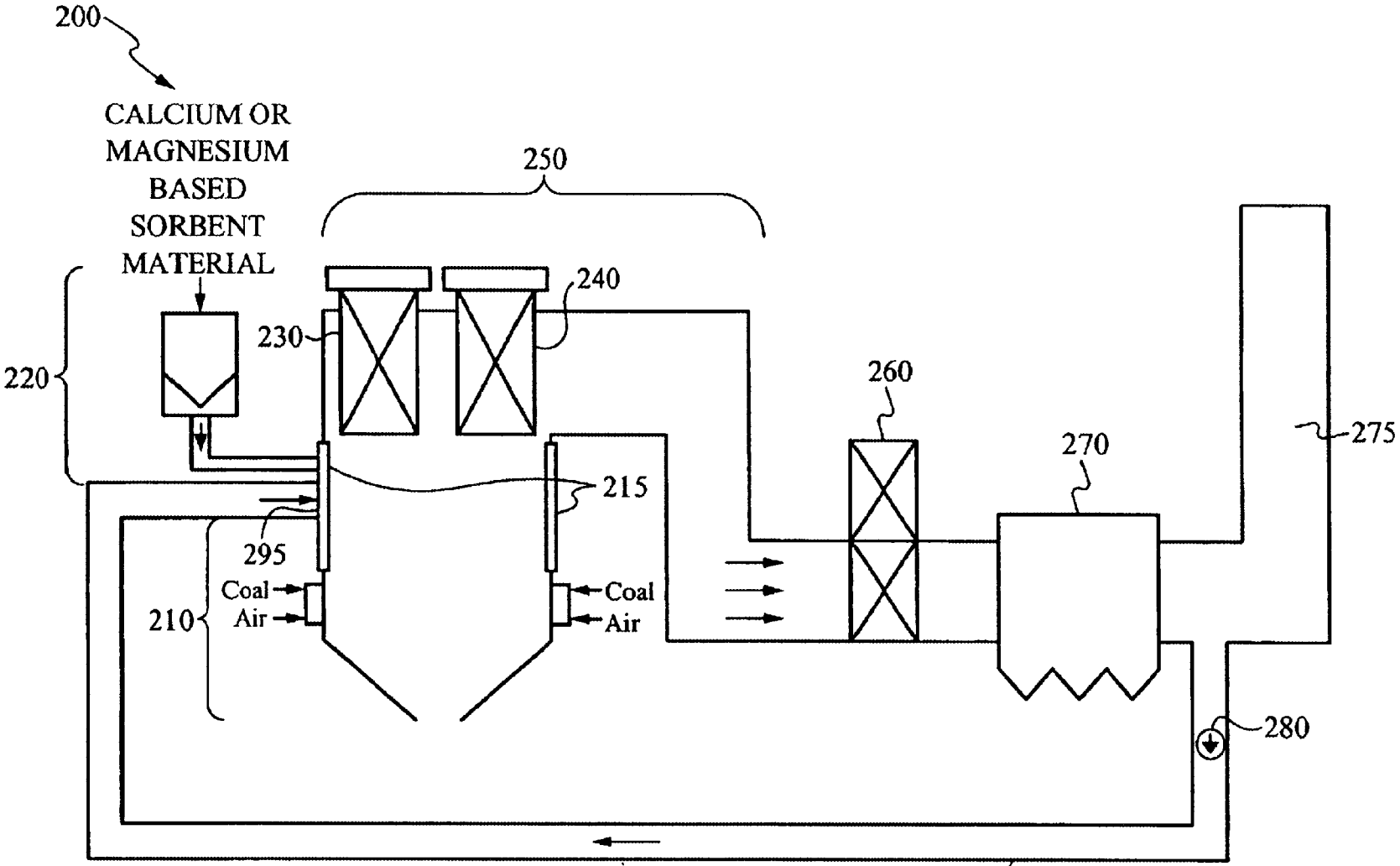
FIG. 2 is a diagram illustrating a simplified furnace system with flue gas recirculation according to an embodiment of the present invention.

FIG. 2 illustrates a simplified furnace boiler system 200 which includes the elements of the system relevant to and in accordance with the preferred embodiment of the present invention. The furnace 250 includes the firebox 210 where coal is burned to heat water for producing high-pressure steam. In the upper furnace 220, the superheater 230 and the reheater 240 respectively superheats and reheats the steam generated by the heating of the water through the burning coal. Flue gas rises up from the firebox 210 into the upper furnace 220, around the superheater 230 and the reheater 240 and out of the furnace to the air preheater 260 which is the last heat exchange element in the boiler. After the air preheater 260, the flue gas goes through the electrostatic precipitator (ESP) 270 which collects fine particles from the exhaust flue gas. The flue gas at the output of the ESP 270 is clean and practically free of fly ash and has cooled down to its lowest temperature in the system before being emitted from the stack 275.

The preferred embodiment of the present invention takes a portion of the flue gas downstream from the ESP 270 and with the use of the fan 280, recirculates the clean and significantly cooler flue gas through the flue gas duct 290 to the ports 295 located in the upper section of the firebox 210, and injects the cool flue gas using recirculation jets. The recirculation jets may be positioned inside, or farther away from the firebox 210, according to the dimensions of the particular furnace 250 in which the present invention is implemented. The cooler recirculated flue gas mixes with the higher temperature main flue gas coming directly from the coal combustion in the firebox 210, thus reducing the temperature of the main flue gas to below the specific fly ash melting temperature. This process prevents slagging and fouling of the surfaces of the furnace. In particular, this prevents slagging and fouling in the firebox 210, the waterwalls 215, the superheater 230, and the reheater 240, by particles of molten fly ash.

Figure 3:
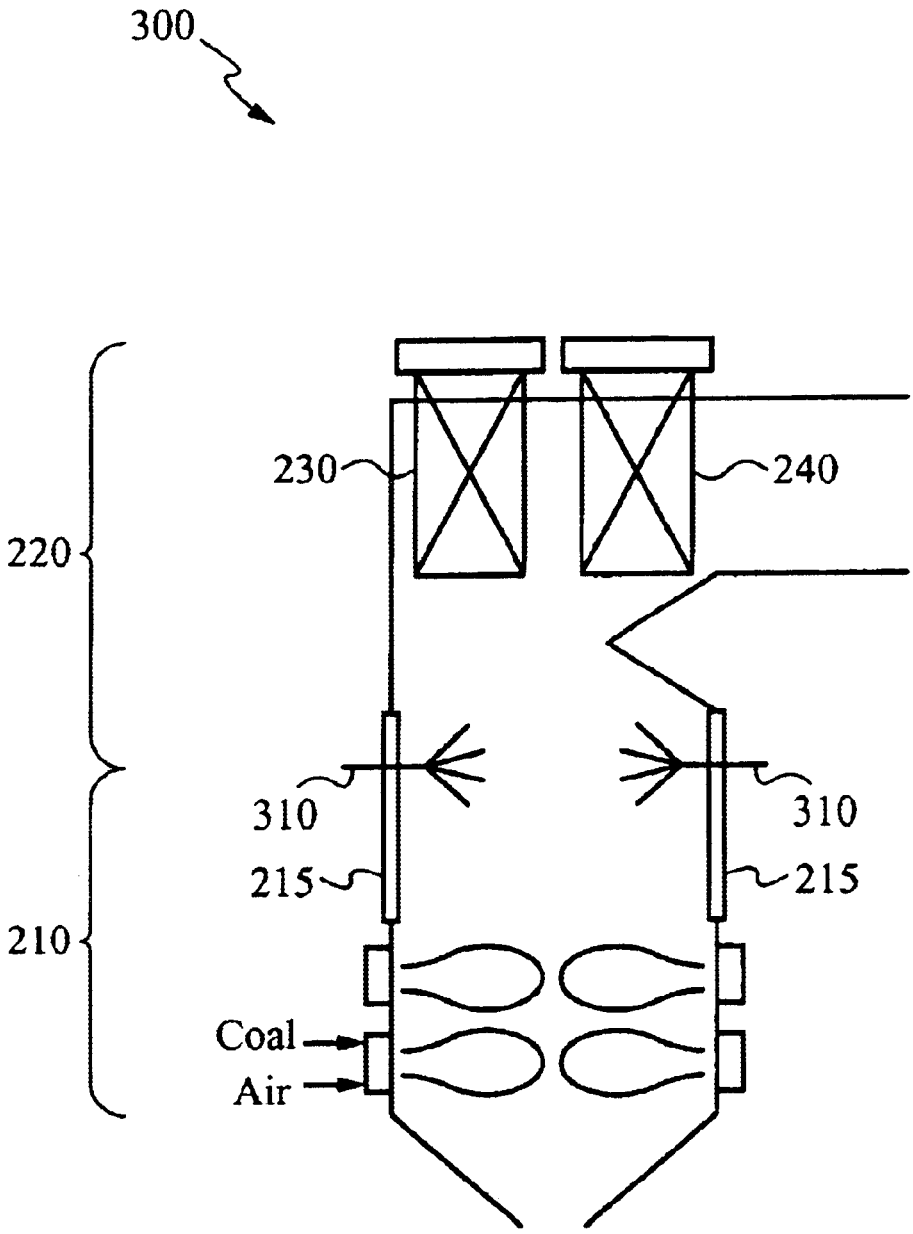
FIG. 3 is a diagram illustrating a simplified furnace with water nozzle jets in the upper section of the firebox according to an alternative embodiment of the present invention.

FIG. 3 illustrates a simplified furnace 300 which includes the elements of the system in accordance with an alternative embodiment of the present invention. The firebox 210, the upper furnace 220, the superheater 230, the reheater 240, and the waterwalls 215 have the same function and relative locations as the same numbered elements in FIG. 2. In addition, in this embodiment there are water jets 310 used to atomize and inject water into one or more ports in the upper section of the firebox 210 in the furnace. The location of the water atomizers and injection ports are chosen such that complete evaporation of the water occurs in the furnace. Of course, this means that the water jets may be positioned inside, or farther away from the firebox 210, according to the dimensions of the particular furnace 250 in which the present invention is implemented. The resulting steam mixes with the flue gas coming directly from the combustion of the coal before the flue gas reaches the top of the firebox 210. In this manner, direct impact of water in the liquid state on the first superheater 230 and reheater 240 tubes in the upper furnace 220 is avoided, thus preventing any adverse effects on the performance and structure of these elements. Furthermore, the mixing of the flue gas with the water vapor needs to occur early enough in the rise of the flue gas from the firebox 210 in order to allow enough time for the fly ash particles to cool down to below the specific ash fusion temperature to prevent slagging and fouling of the furnace 250.

In yet another alternative embodiment of the present invention, a readily available low-cost sorbent additive, preferably $CaCO_3$ or $MgCO_3$ or other similar sorbent, is mixed with water to form a slurry and injected into the upper section of the firebox 210 at the same location as the flue gas recirculation ports 295 shown in FIG. 2. The water slurry jet is carried out by the flue gas recirculation jets and mixes with the main flue gas flow from the furnace. The higher temperature of the main flue gas flow causes the water droplets to evaporate and the sorbent to dissociate, resulting in a significant amount of heat extraction from the main flue gas flow and a corresponding decrease in the temperature of the flue gas. By optimizing the amount of sorbent slurry recirculated in the flue gas in the furnace, slagging and fouling on the surfaces at the boiler furnace is minimized.

The process of flue gas recirculation is useful alone or in conjunction with water injection or slurry injection, or both, to prevent slagging and fouling of the surfaces of the furnace by melted or partially melted fly ash. Preferably, re-circulated flue gas is utilized independently. However, alternative embodiments may include any combination of flue gas recirculation, water injection, and slurry injection. No re-design of the original furnace is necessary in order to implement these processes for preventing slagging and fouling of the surfaces of the furnace due to melted fly ash.

Figure 4:
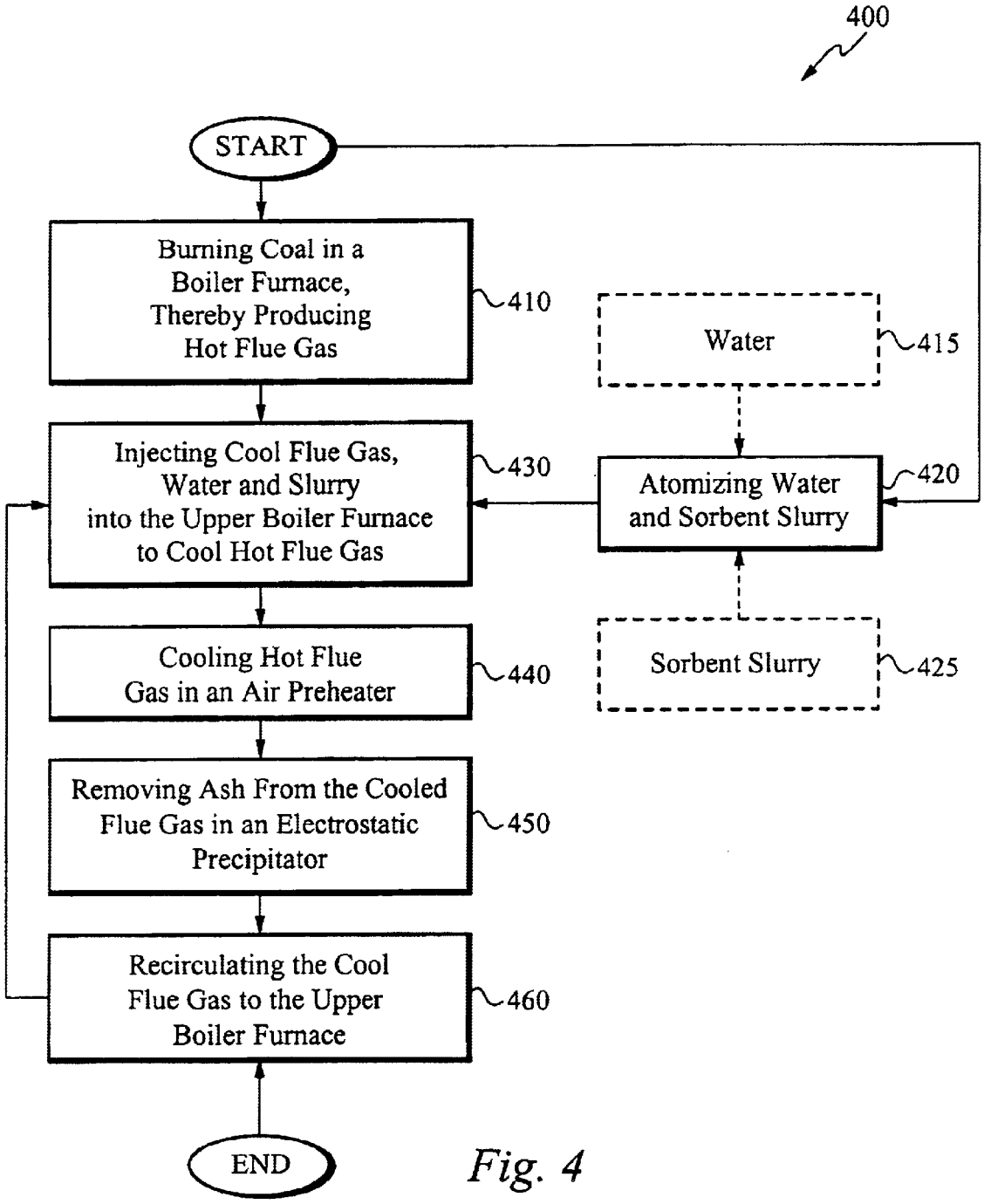
FIG. 4 is a flow chart illustrating a method of reducing slagging and fouling of a coal-fired utility boiler according to an embodiment of the present invention.

FIG. 4 is a flow chart 400 illustrating a method of reducing slagging and fouling of a coal-fired utility boiler according to an embodiment of the present invention. In the step 410, coal is burned in a boiler furnace which produces hot flue gas that rises to the top of the furnace where the superheater and reheater are located. Cooling water is introduced in step 415, and sorbent slurry is introduced in step 425. The water and the sorbent slurry are atomized in step 420. In the step 430, recirculated cooler flue gas, water, and the sorbent slurry are injected into the upper boiler to mix with the hot flue gas from the furnace, thereby reducing the temperature of the hot flue gas. Preferably, re-circulated flue gas is utilized independently. However, alternative embodiments may include any combination of flue gas recirculation, water injection, and slurry injection. In the step 440, the cooling hot flue gas enters an air preheater. In step 450, an ESP removes ash from the cooled flue gas in. Finally, in the step 460, the cool flue gas is recirculated to the upper boiler furnace and injected again to mix with hot flue gas from the furnace in order to reduce the temperature of the hot flue gas.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device of the present invention could be implemented in several different ways and have several different appearances.

What is claimed is:

1. A method of reducing slagging and fouling in a furnace of a coal-fired steam boiler, the method comprising:

a. diverting cooled flue gas from an output of a flue gas filter, wherein the flue gas filter is configured to clean the cooled flue gas by removing fly ash particulates and receive flue gas from an air preheater, the air preheater receiving the flue gas from the furnace;

b. recirculating the cooled flue gas to one or more ports in an upper section of a firebox in the furnace;

c. injecting the cooled flue gas into at least one of the one or more of the ports into the upper section of the firebox; and d. mixing the cooled flue gas with hot flue gas from the furnace, the hot flue gas having a higher temperature than the cooled flue gas, wherein the mixing reduces the higher temperature of the hot flue gas from the furnace to below a threshold temperature.

2. The method as claimed in claim 1 wherein the flue gas filter is an electrostatic precipitator.

3. The method as claimed in claim 1 wherein the flue gas filter is a bag house.

4. The method as claimed in claim 1 wherein the threshold temperature is a temperature at which fly ash melts and forms slag deposits.

5. A method of reducing slagging and fouling in a furnace of a coal-fired steam boiler, the method comprising:

a. atomizing a water-based coolant, wherein the water-based coolant is a sorbent water slurry, and further wherein the slurry includes water and a sorbent material, the sorbent material being magnesium-based;

b. injecting the water-based coolant through at least one of one or more ports into an upper section of a firebox in the furnace; and c. mixing the water-based coolant with hot flue gas from the furnace, the hot flue gas having a higher temperature than the water-based coolant, wherein the mixing reduces the higher temperature to below a threshold temperature.

6. The method as claimed in claim 5 wherein mixing the water-based coolant with the hot flue gas from the furnace evaporates the water and carbonizes the sorbent material in the slurry.

7. The method as claimed in claim 5 wherein the threshold temperature is a temperature at which fly ash melts and forms slag deposits.

8. A system for reducing slagging and fouling in a furnace of a coal-fired steam boiler, the system comprising:

a. a flue gas duct coupled to a flue gas filter, and further coupled to one or more ports in an upper section of a firebox in the furnace, wherein the flue gas duct as configured to divert cooled flue gas, and further wherein the flue gas filter is configured to clean the cooled flue gas and receive flue gas from an air preheater, the air preheater receiving the flue gas from the furnace;

b. at least one fan configured to propel the cooled flue gas through the flue gas duct; and c. at least one recirculation jet to inject the cooled flue gas into one or more of the ports in the upper section of the firebox, wherein the cooled flue gas is mixed with hot flue gas from the furnace, and the cooled flue gas reduces the temperature of the hot flue gas from the furnace to below a threshold temperature.

9. The system as claimed in claim 8 wherein the flue gas filter is an electrostatic precipitator.

10. The system as claimed in claim 8 wherein the flue gas filter is a bag house.

11. The system as claimed in claim 8 wherein the threshold temperature is a temperature at which fly ash melts and forms slag deposits.

12. A system for reducing slagging and fouling in a furnace of a coal-fired steam boiler, the system comprising:

a. at least one atomizer for atomizing a water-based coolant, wherein the water-based coolant is a sorbent water slurry, and further wherein the slurry includes water and a sorbent material, the sorbent material being magnesium-based; and b. at least one injection jet for injecting the atomized water-based coolant through one or more ports into an upper section of a firebox in the furnace to mix with hot flue gas from the furnace, the hot flue gas having a higher temperature than the water-based coolant, wherein the mixing reduces the higher temperature to below a threshold temperature.

13. The system as claimed in claim 12 wherein mixing the water-based coolant with the hot flue gas from the furnace evaporates the water and carbonizes the sorbent material in the slurry.

14. The system as claimed in claim 12 wherein the threshold temperature is a temperature at which fly ash melts and forms slag deposits.

15. A system for reducing slagging and fouling in a furnace of a coal-fired steam boiler, the system comprising:

a. means for diverting cooled flue gas from an output of a flue gas filter, wherein the flue gas filter is configured to clean the cooled flue gas by removing fly ash particulates and receive flue gas from an air preheater, the air preheater receiving the flue gas from the furnace;

b. means for recirculating the cooled flue gas to one or more ports in an upper section of a firebox in the furnace;

c. means for injecting the cooled flue gas into one or more of the ports in the upper section of the firebox; and d. means for mixing the cooled flue gas with hot flue gas from the furnace, the hot flue gas having a higher temperature than the cooled flue gas, wherein the mixing reduces the higher temperature to below a threshold temperature.

16. The system as claimed in claim 15 wherein the flue gas filter is an electrostatic precipitator.

17. The system as claimed in claim 15 wherein the flue gas filter is a bag house.

18. The system as claimed in claim 15 wherein the threshold temperature is a temperature at which fly ash melts and forms slag deposits.

19. A system for reducing slagging and fouling in a furnace of a coal-fired steam boiler, the system comprising:

a. means for atomizing a water-based coolant, wherein the water-based coolant is a sorbent water slurry, and further wherein the slurry includes water and a sorbent material, the sorbent material being magnesium-based;

b. means for injecting the water-based coolant through one or more ports into an upper section of a firebox in the furnace; and c. means for mixing the water-based coolant with hot flue gas from the furnace, the hot flue gas having a higher temperature than the water-based coolant, wherein the mixing reduces the higher temperature to below a threshold temperature.

20. The system as claimed in claim 19 wherein mixing the water-based coolant with the hot flue gas from the furnace evaporates the water and carbonizes the sorbent material in the slurry.

21. The system as claimed in claim 19 wherein the threshold temperature is a temperature at which fly ash melts and forms slag deposits.

22. A method of reducing slagging and fouling in a furnace of a coal-fired steam boiler, the method comprising:

a. diverting cooled flue gas from an output of a flue gas filter, wherein the flue gas filter is configured to clean the cooled flue gas by removing fly ash particulates;

b. recirculating the cooled flue gas to one or more ports in an upper section of a firebox in the furnace;

c. injecting the cooled flue gas into at least one of the one or more of the ports into the upper section of the firebox;

d. atomizing a water-based coolant;

e. injecting the water-based coolant through at least one of the one or more ports into the upper section of the firebox in the furnace; and f. mixing the cooled flue gas and the water-based coolant with hot flue gas from the furnace, the hot flue gas having a higher temperature than the cooled flue gas and the water-based coolant, wherein the mixing reduces the higher temperature to below a threshold temperature.

23. The method as claimed in claim 22 further comprising the flue gas filter receiving flue gas from an air preheater.

24. The method as claimed in claim 23 further comprising the air preheater receiving flue gas from the furnace.

25. The method as claimed in claim 22 wherein the threshold temperature is a temperature at which fly ash melts and forms slag deposits.

26. The method as claimed in claim 22 wherein the water-based coolant is water.

27. The method as claimed in claim 22 wherein the water-based coolant is a sorbent water slurry, and further wherein the slurry comprises water and a sorbent material.

28. A system for reducing slagging and fouling in a furnace of a coal-fired steam boiler, the system comprising:

a. a flue gas duct coupled to a flue gas filter, and further coupled to one or more ports in an upper section of a firebox in the furnace, wherein the flue gas duct is configured to divert cooled flue gas, and further wherein the flue gas filter is configured to clean the cooled flue gas;

b. at least one fan configured to propel the cooled flue gas through the flue gas duct;

c. at least one recirculation jet to inject the cooled flue gas into at least one of the one or more of the ports into the upper section of the firebox;

d. at least one atomizer for atomizing a water-based coolant; and e. at least one injection jet for injecting the water-based coolant into at least one of the one or more ports into the upper section of the firebox in the furnace, wherein the cooled flue gas and the water-based coolant mix with hot flue gas from the furnace having a higher temperature than the cooled flue gas and the water-based coolant mix, and the cooled flue gas and the water-based coolant reduce the temperature of the hot flue gas to below a threshold temperature.

29. The system as claimed in claim 28 wherein the flue gas filter receives flue gas from an air preheater.

30. The system as claimed in claim 29 wherein the air preheater receives flue gas from the furnace.

31. The system as claimed in claim 28 wherein the threshold temperature is a temperature at which fly ash melts and forms slag deposits.

32. The system as claimed in claim 28 wherein the water-based coolant is water.

33. The system as claimed in claim 28 wherein the water-based coolant is a sorbent water slurry, and further wherein the slurry comprises water and a sorbent material.

34. A system for reducing slagging and fouling in a furnace of a coal-fired steam boiler, the system comprising:

a. means for diverting cooled flue gas from an output of a flue gas filter, wherein the flue gas filter is configured to clean the cooled flue gas by removing fly ash particulates;

b. means for recirculating the cooled flue gas to one or more ports in an upper section of a firebox in the furnace;

c. means for injecting the cooled flue gas into at least one or the one or more of the ports into the upper section of the firebox;

d. means for atomizing a water-based coolant;

e. means for injecting the water-based coolant through at least one of the one or more ports into the upper section of the firebox in the furnace; and f. means for mixing the cooled flue gas and the water-based coolant with hot flue gas from the furnace, the hot flue gas having a higher temperature than the cooled flue gas and the water-based coolant, wherein the mixing reduces the higher temperature to below a threshold temperature.

35. The system as claimed in claim 34 wherein the flue gas filter receives flue gas from an air preheater.

36. The system as claimed in claim 35 wherein the air preheater receives flue gas from the furnace.

37. The system as claimed in claim 34 wherein the threshold temperature is a temperature at which fly ash melts and forms slag deposits.

38. The system as claimed in claim 34 wherein the water-based coolant is water.

39. The system as claimed in claim 34 wherein the water-based coolant is a sorbent water slurry, and further wherein the shiny comprises water and a sorbent material.

* * * * *

UNITED STATES PATENT AND TRADEMARK OFFICE

CERTIFICATE OF CORRECTION

PATENT NO. : 6,883,443 B2
APPLICATION NO. : 10/655229
DATED : April 26, 2005
INVENTOR(S) : Terry W. Rettig et al.

It is certified that error appears in the above-identified patent and that said Letters Patent is hereby corrected as shown below:

Claims

Col. 12 Line 4 Claim 39, please delete "shiny" and insert -- slurry --.

Signed and Sealed this

Twenty-ninth Day of January, 2008

JON W. DUDAS
*Director of the United States Patent and Trademark Office*